US007007947B2

(12) United States Patent
Beauchamp

(10) Patent No.: US 7,007,947 B2
(45) Date of Patent: Mar. 7, 2006

(54) MEDIA STORAGE BIN AND METHOD OF USING SAME

(75) Inventor: Robert Warren Beauchamp, Carlsbad, CA (US)

(73) Assignee: Hewlett-Packard Development Company, LP., Houston, TX (US)

( * ) Notice: Subject to any disclaimer, the term of this patent is extended or adjusted under 35 U.S.C. 154(b) by 151 days.

(21) Appl. No.: 10/639,934

(22) Filed: Aug. 13, 2003

(65) Prior Publication Data

US 2004/0045844 A1 Mar. 11, 2004

Related U.S. Application Data

(63) Continuation of application No. 09/539,055, filed on Mar. 30, 2000, now Pat. No. 6,631,902.

(51) Int. Cl.
*B65H 31/14* (2006.01)

(52) U.S. Cl. ..... 271/219; 271/217; 271/215

(58) Field of Classification Search ..... 271/207, 271/213, 215, 217, 219, 208, 209, 210, 211, 271/212, 216, 214
See application file for complete search history.

(56) References Cited

U.S. PATENT DOCUMENTS 4,155,643 A * 5/1979 Ladds et al. ..... 355/72
4,220,323 A 9/1980 Smith
4,222,557 A 9/1980 Wu
4,350,333 A * 9/1982 Landa ..... 271/217
4,364,553 A 12/1982 Wilson
4,679,953 A 7/1987 Sone et al.
4,890,825 A 1/1990 McCormick et al.
D311,927 S * 11/1990 Savela et al. ..... D18/49
D321,003 S 10/1991 Kirchner
5,157,450 A * 10/1992 Kim ..... 399/405
5,253,757 A * 10/1993 Locker ..... 206/449
5,291,227 A 3/1994 Suzuki
5,421,660 A 6/1995 Aizawa et al.
5,479,199 A 12/1995 Moore et al.
5,883,658 A 3/1999 Schubert et al.
5,921,406 A 7/1999 Leone
5,921,690 A 7/1999 Shinmachi et al.

* cited by examiner

*Primary Examiner*—Patrick Mackey

(57) ABSTRACT

A media storage bin including a floor and a pair of spaced apart walls specifically spaced to receive pieces of media and to retain the pieces of media in a stacked condition. A drop control flap is mounted to an individual one of the spaced walls for delaying the fall of a piece of media into the bin. This wall includes a top surface. A platform for supporting a stack of pieces of media is disposed in the bin, between the wall top surface and the floor. A helical spring is disposed between the platform and the floor for maintaining the top of the media stack at a predetermined distance from the wall top surface to provide thereby a constant fall distance between an individual one of the pieces of media and the wall top surface. This is accomplished in a manner whereby the spring rate enables the platform to drop the thickness of one piece of media for each piece of media added to the top of the stack.

10 Claims, 1 Drawing Sheet

MEDIA STORAGE BIN AND METHOD OF USING SAME

This application is a continuation of and claims the priority of an application entitled MEDIA STORAGE BIN AND METHOD OF USING SAME, application Ser. No. 09/539,055 filed Mar. 30, 2000 now U.S. Pat. No. 6,631,902.

BACKGROUND OF THE INVENTION

The present invention relates generally to printing devices and, more particularly, to a printer media storage bin and method of using the same.

Modern printing devices utilize printheads or drop ejectors that are often mounted in a carriage that is moved back and forth across print media, such as paper or envelopes, for example. During the printing process, as the printheads move across the print media, a control system activates the printheads to deposit or eject ink droplets onto the print media to form images and text.

Throughput is often an important factor in printing processes and, as a result, a printer manufacturer can be under pressure to find techniques for increasing throughput, without diminishing print quality. In some cases, especially in tabletop printers, the goal of high throughput is achieved at a cost of printed media smearing. Such smearing occurs downstream of the printing process, at a place where the printed pieces of media are received and temporarily stored. As a rule, the smearing occurs as a piece of newly printed media rubs across another piece of media, before the ink on the latter has dried.

Designers of conventional printers have realized the problems presented by smearing of the printed media and they have taken steps to eliminate them. One approach to eliminate the smearing problem has been to provide heaters to aid the drying process. Such heaters are relatively large and expensive. In addition, the heaters can present a potential fire hazard and, since they dry the air around the printheads, they create an environment that is detrimental to the printheads. Thus, use of heaters to eliminate smearing may have some utility but the technique itself presents some limitations.

From the foregoing it will be apparent that there is a need for a post-printing technique whereby smearing of media pieces is substantially eliminated, in a safe, effective and efficient manner. Desirably, such a technique would afford increased throughput while enabling good print quality. In addition, it would be advantageous if such a technique utilized inexpensive components and eliminated the need for heating devices.

DISCLOSURE OF THE INVENTION

According to the present invention, there is provided a media storage bin including a floor and a pair of spaced apart walls specifically spaced to receive pieces of media and to retain the pieces of media in a stacked condition. A drop control flap is mounted to an individual one of the spaced walls for delaying the fall of a piece of media into the bin. This wall includes a top surface. A platform for supporting a stack of pieces of media is disposed in the bin, between the wall top surface and the floor. A helical spring is disposed between the platform and the floor for maintaining the top of the media stack at a predetermined distance from the wall top surface to provide thereby a constant fall distance between an individual one of the pieces of media and the wall top surface. This is accomplished in a manner whereby the spring rate enables the platform to drop the thickness of one piece of media for each piece of media added to the top of the stack.

The media storage bin of the present invention affords several advantages. It enables increased throughput without any sacrifice of print quality. It is inexpensive to produce since the control flap is constructed of readily available materials and the helical spring can be procured without difficulty. Importantly, the invention eliminates the need for heaters while providing a simple and reliable technique for stacking pieces of printed media while substantially eliminating rubbing of the pieces during the stacking process. As a result, the smearing problem is substantially eliminated in an efficient and effective manner.

Other aspects and advantages of the present invention will become apparent from the following detailed description, taken in conjunction with the accompanying drawings, illustrating by way of example the principles of the invention.

BEST MODE FOR CARRYING OUT THE INVENTION

Figure 1:
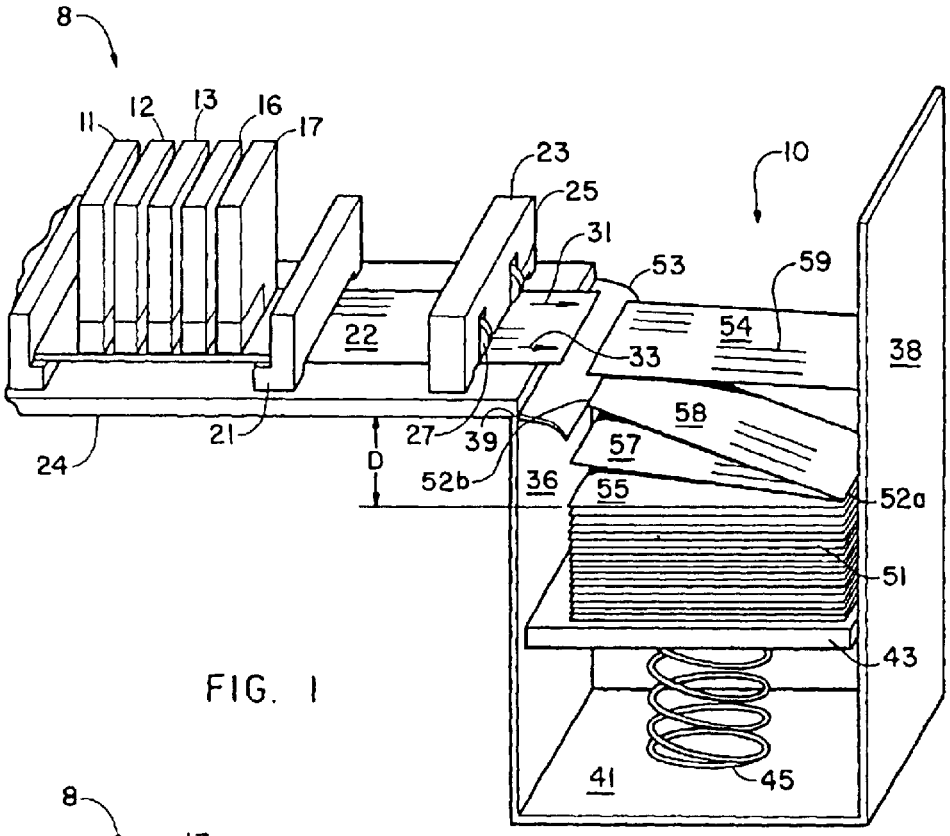
FIG. 1 is a schematic view of a media storage bin constructed according to the present invention showing one media stack configuration.

The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes that come within the meaning and range of equivalency of the claims are to be embraced within their scope.

In the following detailed description and in the drawings, like elements are identified with like reference numerals. As shown in the drawings for purposes of illustration, the invention is embodied in a novel media storage bin for receiving and stacking printed pieces of media. A drop control flap aids in preventing rubbing one media piece against another, thereby substantially reducing smearing while the spring maintains a constant fall distance for the media pieces.

Referring now to FIG. 1 of the drawings, there is shown a media storage bin 10 that is constructed according to the present invention. The storage bin 10 is located downstream of a printer, generally indicated by the reference numeral 8, and the bin 10 receives and stores pieces of media that have undergone a printing process. The printer 8 includes print cartridges 11, 12, 13, 16 and 17 that, responsive to control signals, eject ink droplets onto a piece of media, such as the media piece 22. The cartridges 11, 12, 13, 14 and 17 are supported on a support 21 that, in turn, rests on a base 24. The printer 8 includes a media guide 23 for controlling the path of travel of the media piece 22 through the printer 8 and into the bin 10. In this regard, a pair of drive rollers 25 and 27, mounted in the guide 23, propel the media piece 22 along a path shown by the arrows 31 and 33, into the bin 10.

The bin 10 is rectangular in shape and it includes a pair of spaced apart walls 36 and 38 that are specifically spaced to accept pieces of printed media. The wall 36 includes a top surface 39. While it will be appreciated that the present invention is suitable for handling various types of media, FIG. 1 depicts the pieces of media as envelopes 55, 57, 58 and 59. Thus, where the envelopes 55, 57, 58 and 59 are "business" envelopes having a length of about 9 and ⅜ inches, the distance between the walls 36 and 38 is about 9 and ⅝ inches to about 9 and ¾ inches. This distance enables effective stacking of the envelopes in the bin 10.

The bin 10 includes a floor 41 and a platform 43 for receiving pieces of printed media, such as the envelopes 55, 57, 58 and 59. Each one of the envelopes, such as the envelope 58, for example, includes a leading edge 52*a* and a trailing edge 52*b*. It will be noted, with reference to FIG. 1, that the media pieces, such as the envelope 59, fall onto the stack 51 with printed indicia, such as the indicia 54, facing upward. Because of the specific spacing between the walls 36 and 38, the media pieces fall onto the platform 43 in a manner whereby the media pieces form an orderly stack, such as the stack 51, in which the leading and trailing edges of the respective individual envelopes are substantially aligned.

The bin 10 includes a drop control flap 53 that is mounted adjacent the wall top surface 39. The flap 53 is constructed of flexible plastic material and in cross section it curves downwardly, in the direction of the floor 41. The drop control flap 53 cooperates with an helical spring 45, disposed between the floor 41 and the platform 43, to eliminate smearing on printed documents such as the envelopes 55, 57, 58 and 59. Such smearing prevention is accomplished in a novel manner, without any need for heaters.

The smearing prevention technique accomplished by the present invention will be readily understood by reference to FIG. 1 and to the envelope 58. As shown in the figure, the envelope 58 has undergone the printing process in the printer 8 and is disposed between the envelopes 57 and 59 as all three are falling onto the stack 55. The envelope 58 includes leading and trailing edges 52*a* and 52*b*, respectively. Propelled by the rollers 25 and 27, the envelope 58 is moved into the bin 10 so that the leading edge 52*a* strikes the wall 38. Immediately thereafter, the trailing edge 52*b* engages the drop control flap 53. Momentary engagement of the envelope 58 with the control flap 53 slows the downward passage of the envelope 58 thereby permitting some drying of the ink on the envelope while enabling the envelope leading edge 52*a* to fall more rapidly than the trailing edge 52*b*. In this manner, the leading edge 52*a* reaches the top of the stack 55 first while the opposite end of the envelope, near the trailing edge 52*b*, follows. As a result, smearing of indicia on the envelope 57 is prevented as the envelope 58 settles gently into place on top of the stack 55, without rubbing across the previously printed envelope 57.

A predetermined document fall distance is important in order to achieve an orderly stack of media pieces while eliminating rubbing between pieces. A fall distance D, between the top surface 39 and the top of the media stack 51 is shown in FIG. 1. In a preferred embodiment of the invention, a distance D of between about one inch and about 3 inches is suitable in the case of printed envelopes. Since the weight of the stack 51 is proportional to the height of the stack, a spring constant for the spring 45 is selected in order to maintain the distance D constant. The spring constant can be expressed by the relationship $K=\rho g(wL)$ whereby the spring rate drops the stack 51 one envelope thickness for the weight of each envelope, such as the envelope 55, set on top of the stack 51.

Figure 2:
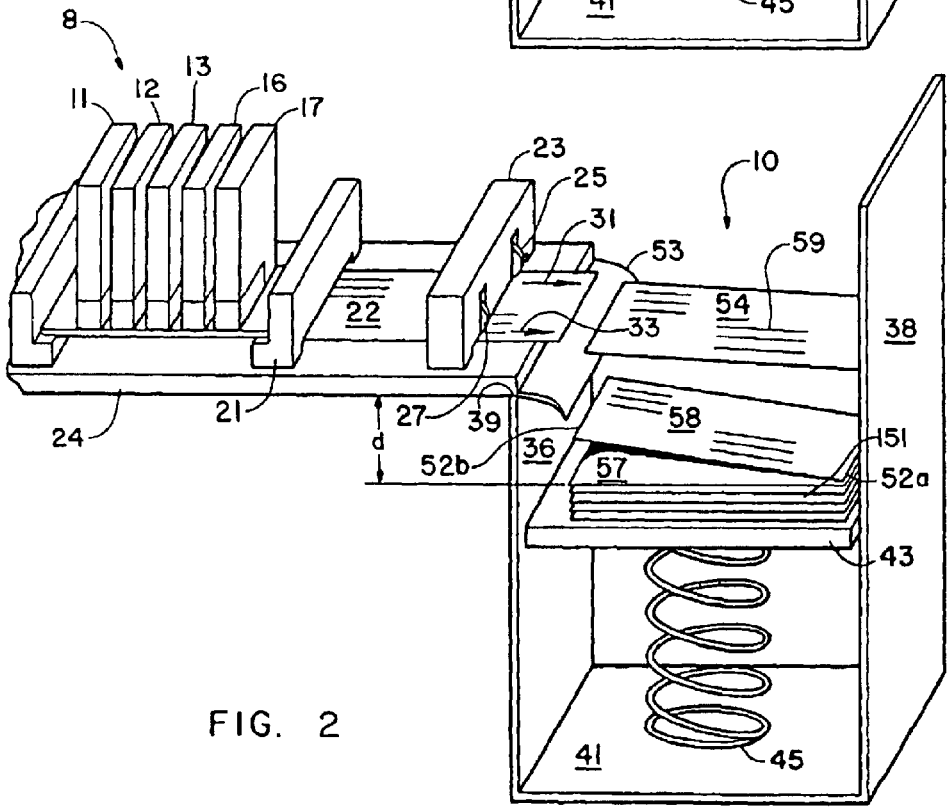
FIG. 2 is a schematic view of a media storage bin constructed according to the present invention showing another media stack configuration.

The function of the spring 45 can be better understood by reference to FIG. 2, wherein like elements are identified with like reference numerals. Here, a media stack 151 is shown that, because of fewer pieces, the stack 151 is shorter, and therefore lighter, than the stack 51 of FIG. 1. Nevertheless, because of the selected spring constant for the spring 45, the top of the stack 151 is maintained at a distance d from the top surface 39 that is equal to the distance D of FIG. 1.

It will be recognized by those skilled in the art that, while envelopes have been described as examples of pieces of printed media, the present invention is not limited to receiving envelopes only. Thus, cards or relatively stiff paper or other media can be processed by the invention.

From the foregoing it will be appreciated that the media storage bin provided by the invention provides an efficient technique for receiving printed media pieces while substantially eliminating the smearing problem. The bin is mechanically simple, easy to assemble and comprised of readily available components. Any need for complicated drying devices, such as heaters, is eliminated, thereby making a more efficient, effective and safe printer possible.

It will be evident that there are additional embodiments and applications which are not disclosed in the detailed description but which clearly fall within the scope of the present invention. The specification is, therefore, intended not to be limiting, and the scope of the invention is to be limited only by the following claims.

What is claimed is:

1. A media storage bin for receiving printed media, the media storage bin comprising:

a floor and a pair of spaced apart walls, at least one of said pair of spaced apart walls including a top wall surface, the pair of spaced apart walls spaced to receive pieces of media and to retain said pieces of media in a stacked condition;

a drop control flap mounted to an individual one of said pair of spaced apart walls, the drop control flap projecting into the bin, for engaging a piece of media, to delay the fall of said piece of media;

a platform for supporting a stack of pieces of media, said platform being disposed in said bin between said floor and said wall top surface; and a spring disposed between said platform and said floor for maintaining the top of said stack at a predetermined distance from said top surface to provide thereby a constant fall distance between an individual one of said pieces of media and said top surface.

2. The media storage bin according to claim 1, wherein said drop control flap is mounted on said wall adjacent said wall top surface.

3. The media storage bin according to claim 1, wherein said drop control flap is curved downwardly in the direction of said floor.

4. The media storage bin according to claim 1, wherein said drop control flap is composed of resilient material.

5. The media storage bin according to claim 1, wherein said spaced walls are separated by a distance that exceeds the length of each one of said pieces of media.

6. The media storage bin according to claim 5, wherein said distance is between about ⅛ inch and about ⅜ inch.

7. The media storage bin according to claim 1, wherein said spring is a helical spring.

8. The media storage bin according to claim 1, wherein said predetermined distance is between about one inch and about three inches.

9. A method of collecting a stack of pieces of media comprising the steps of:

providing a media storage bin, said bin including a floor and a pair of spaced apart walls, at least one of said pair of spaced apart walls including a top wall surface, said pair of spaced apart walls spaced to receive pieces of media to retain said pieces of media in a stacked condition;

providing a drop control flap mounted to an individual one of said pair of spaced apart walls and projecting into said bin to engage a piece of media to delay the fall of a piece of media into the bin said individual one of said spaced apart wall including a top surface;

providing a platform in said bin for supporting a stack of pieces of media, said platform being disposed between said floor and said wall top surface; and maintaining the top of said stack of pieces of media at a predetermined distance from said top surface to provide thereby a constant fall distance between an individual one of said pieces of media and said top surface.

10. The method of collecting a stack of pieces of media according to claim 9, including maintaining a distance of between about one inch and about three inches between the top of said stacked pieces of media and said top surface during the collection process.

* * * * *

UNITED STATES PATENT AND TRADEMARK OFFICE

CERTIFICATE OF CORRECTION

PATENT NO. : 7,007,947 B2
APPLICATION NO. : 10/639934
DATED : March 7, 2006
INVENTOR(S) : Robert Warren Beauchamp It is certified that error appears in the above-identified patent and that said Letters Patent is hereby corrected as shown below:

On the title page, item (73), in "Assignee", in column 1, line 2, delete "LP.," and insert -- L.P., --, therefor.

In column 5, lines 7-8, in Claim 9, after "bin" delete "said individual one of said spaced apart wall including a top surface".

Signed and Sealed this

Fourteenth Day of July, 2009

JOHN DOLL
*Acting Director of the United States Patent and Trademark Office*